United States Patent [19]

Gorin

[11] Patent Number: 4,578,175

[45] Date of Patent: Mar. 25, 1986

[54] COMBINED PROCESS FOR COAL PYROLYSIS AND CHAR GASIFICATION

[75] Inventor: Everett Gorin, San Rafael, Calif.

[73] Assignee: Conoco Inc., Wilmington, Del.

[21] Appl. No.: 595,759

[22] Filed: Apr. 2, 1984

[51] Int. Cl.[4] ..... C10G 1/00

[52] U.S. Cl. ..... 208/8 R

[58] Field of Search ..... 208/8 R, 10, 11 R

[56] References Cited

U.S. PATENT DOCUMENTS

| | | | |
|---|---|---|---|
| 2,991,164 | 7/1961 | Elliott et al. | 208/8 R |
| 3,861,885 | 1/1975 | Schora | 208/8 R |
| 3,926,775 | 12/1975 | Schroeder | 208/8 R |
| 3,963,598 | 6/1976 | Manowitz et al. | 208/8 R |
| 4,085,030 | 4/1978 | Green et al. | 208/11 R |
| 4,097,361 | 6/1978 | Ashworth | 208/8 R |
| 4,162,959 | 7/1979 | Durai-Swamy | 208/11 R |
| 4,166,786 | 9/1979 | Durai-Swamy et al. | 208/11 R |
| 4,204,943 | 5/1980 | Metrailer et al. | 208/8 LE |
| 4,218,287 | 8/1980 | Albright et al. | 208/8 R |
| 4,229,185 | 10/1980 | Sass | 208/8 R |
| 4,234,408 | 11/1980 | Duncan | 208/8 R |
| 4,298,453 | 11/1981 | Schoennagel et al. | 208/8 R |
| 4,331,529 | 5/1982 | Lambert et al. | 208/8 R |
| 4,336,128 | 6/1982 | Tamm | 208/11 R |
| 4,404,083 | 9/1983 | Vasalos | 208/8 R |
| 4,405,442 | 9/1983 | Deschamps et al. | 208/107 |

FOREIGN PATENT DOCUMENTS

82/00655 3/1982 PCT Int'l Appl. ..... 208/8 R

OTHER PUBLICATIONS

Simbeck et al., "Coal Liquefaction: Direct v. Indirect—Making a Choice", Oil & Gas Journal, May 4, 1981, pp. 254–268.

*Chemistry of Coal Utilization*, 2nd Sup. vol., John Wiley & Sons, 1981, pp. 2110–2111.

*Primary Examiner*—John Doll

*Assistant Examiner*—Lance Johnson

*Attorney, Agent, or Firm*—William A. Mikesell, Jr.; Cortlan R. Schupbach

[57] ABSTRACT

Finely divided coal is reacted in a combination of processes comprising flash pyrolysis and fluidized bed gasification of char from the pyrolysis. A portion of the char which is heated by the steam-oxygen gasification provides the heat for the pyrolysis step, which can be controlled to emphasize production of such materials as light olefins and BTX pyrolyzing at lower pressure and more severe temperature, or to emphasize production of a tar, suitable for processing as a synthetic crude oil, by pyrolyzing at higher pressure and less severe temperature. In either instance the fluidized bed gasification produces a useful synthesis gas.

4 Claims, 2 Drawing Figures

COMBINED PROCESS FOR COAL PYROLYSIS AND CHAR GASIFICATION

BACKGROUND OF THE INVENTION

Ashworth U.S. Pat. No. 4,097,361 discloses a continuous deep hydrogenation coal liquefaction process using a slurry of powdered coal in a recycle solvent which after hydroextraction passes heavy coal extract into low temperature fluidized bed pyrolysis. The char from the pyrolysis unit is fed to high temperature fluidized bed char gasification.

Manowitz U.S. Pat. No. 3,963,598 discloses a process for hydrogenation of coal by contacting powdered coal with hydrogen in a rotating fluidized bed reactor. The coal residence time in the reactor is limited to less than 5 seconds while the hydrogen contact time is not in excess of 0.2 seconds.

Metrailer et al U.S. Pat. No. 4,204,943 discloses a combination slurry hydroconversion, coking and coke gasification process in which carbonaceous solids having an average particle size of less than 10 microns in diameter are used as a catalyst in the hydroconversion stage.

Conversion of coal to gaseous and liquid products is attended by various difficulties. One problem associated particularly with coals from the eastern United States is that of caking.

SUMMARY OF THE INVENTION

This invention relates to conversion of coal to valuable gaseous and liquid products by a process comprising a combination of a flash pyrolysis and ash-agglomerating fluidized gasification of the resulting char. According to this invention, the process can be operated to emphasize as desired from a product slate which varies from heavy materials such as tar, through progressively lighter materials such as naphthalene, a benzene-toluene-xylene mix (BTX), light olefins such as ethylene and propylene, to synthesis gas comprising a mixture of carbon monoxide and hydrogen. The product range is controlled primarily by setting the temperature and pressure in the pyrolysis zone.

Coal, preferably a bituminous caking coal of high volatiles content, is passed in finely divided form to a flash pyrolysis wherein it is subjected to a temperature in the range of 500° to 950° C. and a pressure in the range of about 3 to about 33 atmospheres absolute. Gaseous and vaporized liquid products are recovered and separated, while pyrolysis solids comprising char and ash are passed to a fluidized gasification zone. In this latter zone, fluidization is effected by injection of steam and an oxygen-containing gas, resulting in production of a raw gas which is purified and utilized as a chemical synthesis feed, and a by-product stream of ash agglomerate.

Figure 1:
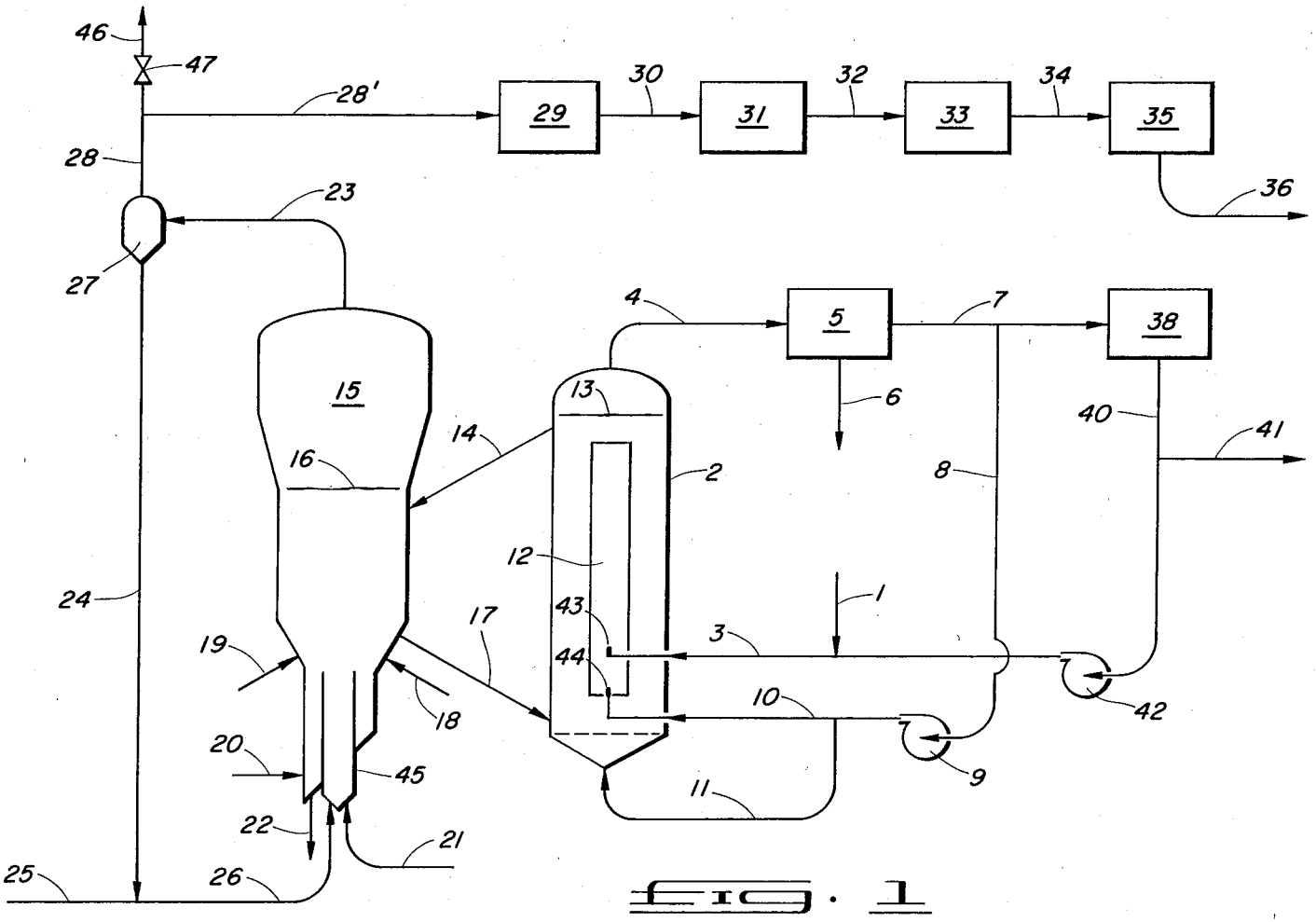
FIG. 1 illustrates an embodiment of the method in accordance with the present invention designed to maximize yield of heavier product such as tar by using fluidized bed pyrolyzer with draft tube.

Reference is now made to a detailed description of the drawing for a more complete understanding of the invention.

DETAILED DESCRIPTION OF THE INVENTION

Reference is first made to the embodiment of FIG. 1, wherein relatively lower temperatures and higher pressures within the above-cited ranges favor maximum yield of tars, in addition to synthesis gas. Finely divided coal is fed through line 1 into a recycle gas stream 3. Recycle gas stream 3 introduces the coal and gas mixture into the fluidized bed pyrolyzer 2 which is provided with a draft tube 12. Gases injected upwardly through injection ports 43 and 44 cause the solids in pyrolyzer 2 to circulate continuously upward through tube 12 and downward in the annulus between tube 12 and the wall of pyrolyzer 2. Coal is pyrolyzed in the tube 12 to form a gaseous product which leaves through line 4, and a solid product which leaves through line 14. Tar is recovered from the gaseous product of pyrolysis in the tar recovery unit 5. The tar is conveyed to storage through line 6.

Solids pass from the upper end of the pyrolyzer 2 through line 14 to the gasifier 15. Steam is fed through lines 18 and 19 to the gasifier 15. Fluidized bed gasification takes place in the gasifier 15. The devolatilized char solids entering by way of line 14 from the pyrolyzer 2 are carbonaceous in nature, and the reaction with steam produces a mixture of carbon monoxide and hydrogen which leaves the gasifier 15 through line 23. Any entrained carbonaceous solids may be separated from the gaseous product in the solids-gas separation device 27. The solids are recycled through line 24 to line 26 where they are returned along with steam from line 25 into the gasifier. The hydrogen and carbon monoxide products of gasification pass through line 28 and 28' through waste heat boiler 29 wherein waste heat is recovered to form steam. Alternatively, a portion of the hydrogen and carbon monoxide may be passed through valve 47 in line 46 for use as a fuel gas.

The cooled gaseous mixture of hydrogen and carbon monoxide is passed through line 30 into water gas shift reactor 31 wherein a portion of the carbon monoxide reacts with water to form hydrogen and carbon dioxide. This mixture of hydrogen, carbon monoxide, and carbon dioxide passes through line 32 into acid gas removal unit 33. Sulfur-containing gases are removed in the acid gas removal unit 33. The hydrogen rich product gas can be passed through line 34 to methanol synthesis unit 35, wherein CO and hydrogen contact a methanol synthesis catalyst.

Draft tube pyrolyzer 2 when operated to maximize tar yield, can convert as much as about 30% of the coal feed to tar on an MAF basis. To do so, the pyrolysis zone is operated at a temperature of about 500° to about 700° C., more preferably about 550° to about 650° C., and a pressure between about 10 and about 33 atmospheres absolute. Pyrolyzer 2 is maintained in a fluidized and circulating condition, with a solids level as shown at 13, by returning a portion of the gas which was removed via line 4 and subjected to tar recovery at unit 5. The remaining gas in line 7 will comprise primarily a mixture of hydrogen with light hydrocarbons, and a portion of this gas is passed by line 8 to a compressor 9. From compressor 9, a fraction of the gas in line 10 is passed directly to injection port 44 to cause draft-tube circulation, and the remainder is passed by way of line 11 into the bottom of pyrolyzer 2 to maintain fluidization.

Another portion of the gas in line 7 is used to ultimately introduce fresh finely divided coal feed from line 1 via line 3 and injection port 43 into pyrolyzer 2. This portion from line 7 is usually but not necessarily enriched in hydrogen, as by steam reforming, in unit 38. Hydrogen sulfide and/or carbon dioxide can also be separated from this recycling gas, and a hydrogen-rich product gas can be obtained for example at line 41. Primarily, however, this gas is recycled via line 40 and compressor 42 to transport coal from line 1 as mentioned.

Returning now to operation of gasifier 15, fluidization of the char and ash solids as shown by level 16 is effected not only by the steam introduced by lines 18 and 19, but also by an oxygen-containing gas such as air or oxygen-enriched air introduced by line 21 into separator leg 45. Ash, withdrawn via line 22, is first stripped of gas values by steam from line 20.

A portion of the hot char inventory from gasifier 15 is continually added to pyrolyzer 2 by way of line 17 to provide pyrolysis heat. Depending upon heat loss, line sizes, etc. of the specific equipment, the weight ratio of solids feeds to pyrolyzer 2 as expressed by char rate in line 17 to coal rate in line 1, can vary between about 1.5:1 and about 4:1. The total solids inventory in pyrolyzer 2 is such that the weight ratio of solids flow in draft tube 12 is from about 15 to about 50 times the fresh coal feed rate from line 1. Of the total coal feed in line 1, about 50 to about 65 weight percent MAF is volatilized in pyrolyzer 2, and about 35 to about 50 weight percent is gasified in gasifier 15.

Figure 2:
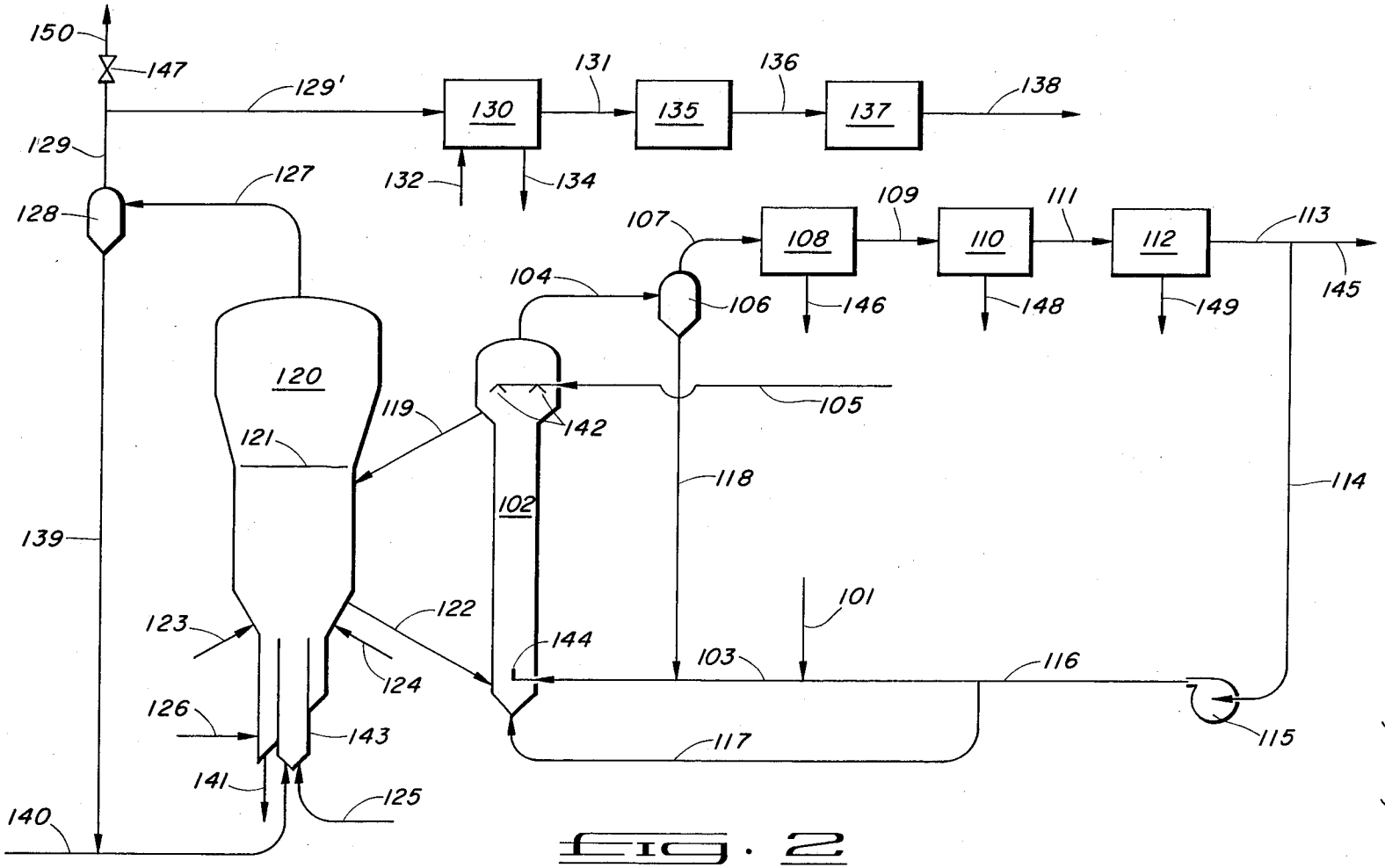
FIG. 2 illustrates an embodiment of the method in accordance with the present invention designed to maximize yield of lighter products such as BTX and ethylene by using a flash pyrolysis unit without draft tube.

Attention is now directed to the embodiment illustrated in FIG. 2, wherein the objective is to maximize yield of lighter products such as naphthalene, BTX, and light olefins. In this embodiment, the draft tube pyrolyzer is replaced by a flash pyrolysis unit 102. Conditions in this pyrolysis zone include a higher temperature, viz from about 800° to about 950° C., preferably between about 850° and about 925° C., and a lower pressure, i.e. from about 3 to about 10 atmospheres absolute.

In this embodiment, coal is fed through line 101 into line 103. Recycle gas in line 116 mixes with the coal in line 103. Recycle char from line 118 passes into line 103 and mixes with the coal and recycle gas therein. The mixture of coal char and recycle gas in line 103 is fed through injection port 144 into the flash pyrolysis tube 102.

A portion of the recycle gas in line 116 passes into line 117 which feeds into the bottom of flash pyrolysis tube 102. The gas from line 117 passes upwardly through the flash pyrolysis tube 102 carrying with it char solids from line 122 and the mixture of char, coal and recycle gas being injected through port 144. The hot char in line 122 passes into the flash pyrolysis tube 102 at a temperature of about 1000° C. The ratio of hot char to coal in the flash pyrolysis tube is about 10–50:1 on a weight basis.

Thermal cracking occurs within the flash pyrolysis tube 102, which promotes the volatilization of volatiles from the bituminous coal therein. Sprayers 142 spray hydrogenated tar into the upper portion of the flash pyrolysis tube 102, which tar undergoes some thermal cracking, and also aids in reducing solids entertainment.

Solids from the flash pyrolysis tube are fed through line 119 to the fluidized bed gasifier 120. The solids 121 within the fluidized bed gasifier 120 are maintained in a fluidized state by steam injected through lines 123 and 124, a mixture of oxygen and steam fed through line 125, stripping steam fed through line 126 and a mixture of steam and recycle gas fed into tube 143 through line 140. Ash and agglomerates are removed from the fluidized bed gasifier 120 through line 141.

Gaseous products of gasification pass through line 127 from fluidized bed gasifier 120. Entrained solids are separated in solids gas separator 128, and returned through line 139 to line 140. The gases pass through line 129 to waste heat boiler 130. Waste heat boiler 130 is fed with water through line 132, and produces steam through line 134. The cooled gaseous products of gasification pass through line 131 to the water gas shift unit 135. The carbon monoxide product of gasification reacts with water from a line, not shown, in the water gas shift unit 135.

The products of water gas shift pass through line 136 to the acid gas removal unit 137. The acid gas removal unit 137 removes hydrogen sulfide gas. The gaseous products after acid gas removal pass through line 138 to a methanol synthesis reactor means. The gases passing through line 138 are rich in carbon monoxide and hydrogen. This mixture is readily reacted to form methanol.

The gaseous products of flash pyrolysis pass from flash pyrolysis tube 102 through line 104 to the solids gas separator 106. The solids from the solids gas separator 106 pass through line 118. The gases from the solids gas separator as well as the tar entrained therein pass through line 107 to tar recovery unit 108. A portion of the tar recovered in tar recovery unit 108 can be passed through line 146 to hydrogen enrichment, not shown. Catalytic hydrotreating under pressure is carried out by means known to those of ordinary skill in the art. Hydrogen enriched tar from the hydrogen enrichment unit, or alternatively the lighter fraction of the tar recovered in unit 108, passes through line 105 to sprayers 142. The hydrogen enriched tar improves the net yield of olefins and light aromatic hydrocarbons in flash pyrolysis. Gases from the tar recovery unit 108 pass through line 109 to the light oil recovery unit 110.

The benzene, toluene, xylene, napthalene fraction passes from light oil recovery unit 110 through line 148. The lower molecular weight gaseous materials pass through line 111 to ethylene recovery unit 112. The ethylene products from the ethylene recovery unit 112 pass through line 149. The unliquified portion of the gas passes from ethylene recovery unit 112 through line 113. A portion of the gas in line 113 passes through line 114 to compressor 115 for recycle through line 116. The remainder of the gas from ethylene recovery unit 112 passes through line 145 to hydrogen manufacture. Hydrogen manufacture is carried out as discussed above for example by hydrogen sulfide removal followed by steam reforming and carbon dioxide removal.

Char from the gasifier 120 is fed through line 122 to the bottom portion of flash pyrolysis tube 102, and is at a temperature from between 900° and 1200° C. The residual heat of this char provides the heat of pyrolysis in the flash pyrolysis tube 102.

The benzene, toluene, xylene and ethylene produced by this method is from about 12 to about 20 percent of the bituminous coal feed on a moisture and ash free (MAF) basis. A portion of the crude gas in line 129 can be withdrawn via line 150 and valve 147 as fuel; the remainder is routed to line 129'.

As shown in the following TABLE it is important that the partial pressure of hydrogen be below one atmosphere in the recycle gas in line 103. Otherwise the proportion of ethane will increase. The hydrogen partial pressure can be reduced by replacing part of the recycle gas in line 117 with steam.

TABLE

| | Equilibrium Data in Reaction $C_2H_4 + H_2 = C_2H_6$ | | | | |
|---|---|---|---|---|---|
| Temperature, °C. | 827 | | 927 | | |
| Partial Pressure, $H_2$, atm. | 0.1 | 1.0 | 0.1 | 1.0 | 5.0 |
| Equilibrium Ratio, $C_2H_6/C_2H_4$ | 0.055 | 0.55 | 0.014 | 0.14 | 0.70 |

Having thus described the invention by reference to certain of its preferred embodiments it is pointed out that embodiments described are illustrative rather than limiting in nature and that many variations and modifications are possible within the scope of the present invention, as may appear upon a review of the foregoing description.

What is claimed is:

1. The method of converting coal to gaseous and liquid products which consisting essentially of:

(a) admixing finely divided coal into a hydrogencontaining recycle gas stream, (b) providing a vertically elongated pyrolysis zone, (c) introducing the coal-containing recycle gas stream of step (a) into a lower region of said pyrolysis zone, (d) introducing a finely divided particulate heated char into a lower region of said pyrolysis zone, (e) passing the resulting mixture of heated char, finely divided coal, and recycle gas upwardly through said pyrolysis zone at a temperature between about 500° and about 950° C. and a pressure between about 3 and about 33 atmospheres absolute, (f) removing from an upper region of said pyrolysis zone a raw vapor stream comprising tar and lighter hydrocarbons, (g) separating condensible liquid products from said raw vapor stream of step (f) to produce a gas stream, (h) returning at least a portion of said gas stream from step (g) to comprise said recycle gas of step (a), (i) removing from an upper region of said pyrolysis zone a stream of finely divided hot solids comprising char and ash, (j) providing a vertically elongated fluidized bed gasification zone, (k) passing said stream of hot solids from step (i) to an upper region of said gasification zone, (l) directing oxygen-containing gas and steam into a lower region of said gasification zone in amount sufficient to maintain the solids therein in a state of fluidization, (m) withdrawing from a lower region of said gasification zone a stream comprising coal ash, (n) withdrawing from an intermediate region of said gasification zone a stream comprising heated char, (o) passing the withdrawn char of step (n) to said step of introducing in step (d), and (p) withdrawing from an upper region of said gasification zone a synthesis gas product stream comprising carbon monoxide and hydrogen.

2. The method of claim 1 wherein said pyrolysis zone is maintained at a temperature between about 500° and about 700° C. and a pressure between about 10 and about 33 atmospheres absolute, and said heated char and finely divided coal are circulated in a vertically elongated toroidal flow pattern about a draft tube means disposed within said pyrolysis zone.

3. The method of claim 1 wherein said pyrolysis zone is maintained at a temperature between about 800° and about 950° C. and a pressure between about 3 and about 10 atmospheres, and a portion of the tar from step (f) is hydrogenated and then sprayed into an upper region of said pyrolysis zone.

4. The method of claim 3 wherein there is separated from the raw vapor stream of step (f) a product stream comprising ethylene.

* * * * *